United States Patent [19]

Hartley

[11] 4,059,243

[45] Nov. 22, 1977

[54] SKEIN DISPENSER

[76] Inventor: Kenneth H. Hartley, 1206 W. Main St., Williamston, N.C. 27892

[21] Appl. No.: 676,954

[22] Filed: Apr. 14, 1976

[51] Int. Cl.[2] ..... B65H 49/00

[52] U.S. Cl. ..... 242/129.6

[58] Field of Search ..... 242/55.2, 55.3, 127, 242/129.6, 129.62, 132, 134, 137.1, 138

[56] References Cited

U.S. PATENT DOCUMENTS 1,144,775 6/1915 Nollner ..... 242/129.62

*Primary Examiner*—Leonard D. Christian

*Attorney, Agent, or Firm*—Fred Philpitt

[57] ABSTRACT

A device for holding and dispensing a skein of textile material such as yarn or the like, comprising two spaced apart end members positioned adjacent opposite ends of a base and being hingedly attached to the base for pivotal movement toward and away from each other for supporting a rod member adapted to hold a skein of textile material disposed parallel to the base member.

1 Claim, 6 Drawing Figures

FIG. 3
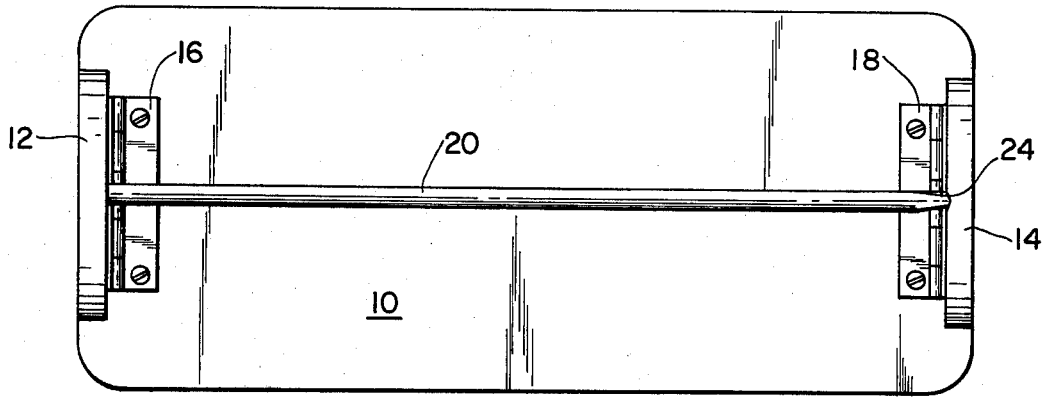
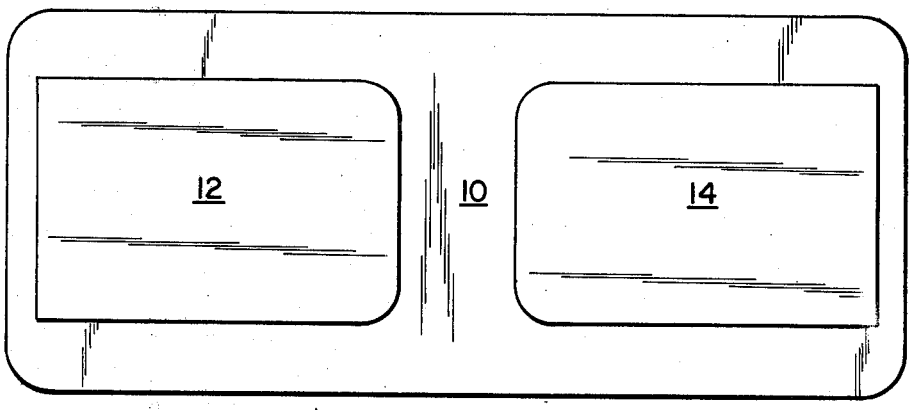
FIG. 4
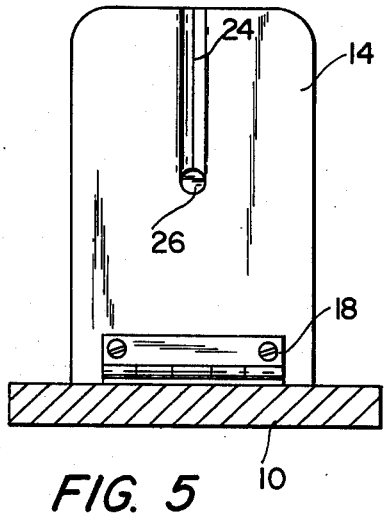
FIG. 5
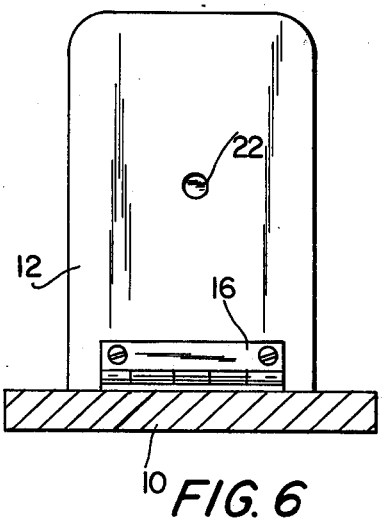
FIG. 6

SKEIN DISPENSER

BACKGROUND OF THE INVENTION

Tens of thousands of women purchase rather bulky skeins of yarn or similar textile material and thereafter create decorative objects of various sorts by unwinding the textile material from the skein as the object is being created. Unfortunately, this unwinding of the skein frequently results in knotting and tangling problems in the skein, with the result that the creative work must be discontinued until the skein can be unknotted and untangled.

An object of this invention is to provide a simple skein holder device which will both hold and dispense a skein of textile material with a minimum of knotting and tangling problems.

THE INVENTION

Considered from one aspect, the present invention involves a device for holding and dispensing a skein of textile material such as yarn or the like, comprising in combination a. a base member having a generally planar and rectangular configuration, b. two spaced apart end members positioned adjacent opposite ends of said base member and which in their operative positions are parallel to each other and perpendicular to said base member, c. two spaced apart hinge members one hinge member connecting one end member to the upper surface of said base member and the other hinge member connecting the other end member to the upper surface of said base member, said hinge members interconnecting said end members to said base member in such a way that the end members can pivot toward and away from each other through an angle of approximately 90°, d. rod seating means located in both of said end members in the sides of the end members that face each other when the end members are in their operative position, e. an elongated rod member extending between said end member when the end members are in their upright operative position, the ends of said rod member being seated in said rod seating means so that the rod member is disposed essentially parrallel to said base member and spaced thereabove, said rod member being adapted to hold a skein of textile material, and f. a groove in the facing service of at least one of said end members, said groove extending between the periphery of said end member and the rod seating means located on one face of said end member, said groove facilitating the seating and unseating of one end of said rod member in a rod seating means.

My invention will now be described with reference to the drawings wherein:

FIG. 3 is a plan view of the unit in its operative condition;

FIG. 4 is a plan view of the unit in its inoperative position with the ends folded down;

FIG. 5 is a view along 5—5 of FIG. 2; and

FIG. 6 is a view along 6—6 of FIG. 2, but with the elongated rod member removed.

The base member 10 preferably has a rectangular configuration and the length of the rectangle is at least as long as an ordinary skein of yarn. The length preferably should fall within the range of about 8 to 15 inches and most preferably about 12 inches, and preferably have a width of from about 3 to 7 inches, and most preferably about 5 inches, so that it can fit into a large pocketbook or the type of carrying case usually used by people who crochet or work with yarn. The base member should have enough weight so that it will not tip over under the tugs and pulls of the user.

The end members 12 and 14 are shown in all figures except FIG. 4 in their upright or operative position, wherein it can be seen that they are both essentially parallel to each other and perpendicular to the base member 10. The precise dimensions and configuration of the end members is not critical, the major consideration being that they do not cause the unit to be so large or bulky that it would be inconvenient to carry. The end members are preferably between about 2.5 and 4.5 inches wide (most preferably about 3.5 inches wide) and preferably between about 3 and 7 inches high (most preferably about 5 inches high).

The end members are detachably connected to the base member by means of hinge members 16 and 18 in such a way that the end members can pivot from a first upright position, where they are essentially parallel to each other (i.e. FIGS. 1 - 3 and 5 - 6) through an angle of about 90° to a second position (FIG. 4) where they are essentially in the same plane and also parallel to the base member 10. When the end members are in their upright position, the hinge members and the way in which the end members are attached to the hinge members, prevent the end members from pivoting away from each other.

Figure 1:
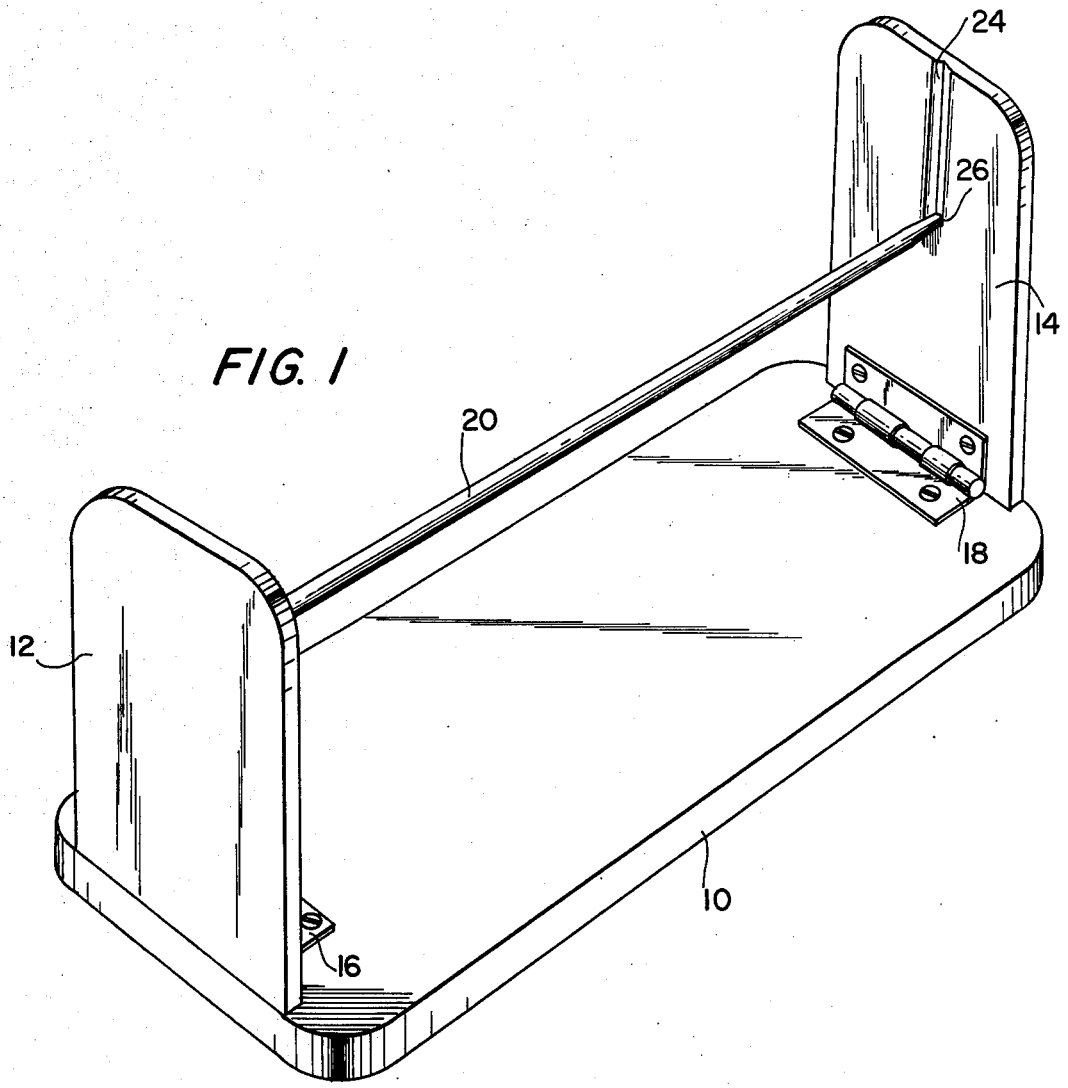
FIG. 1 is a perspective view.
Figure 2:
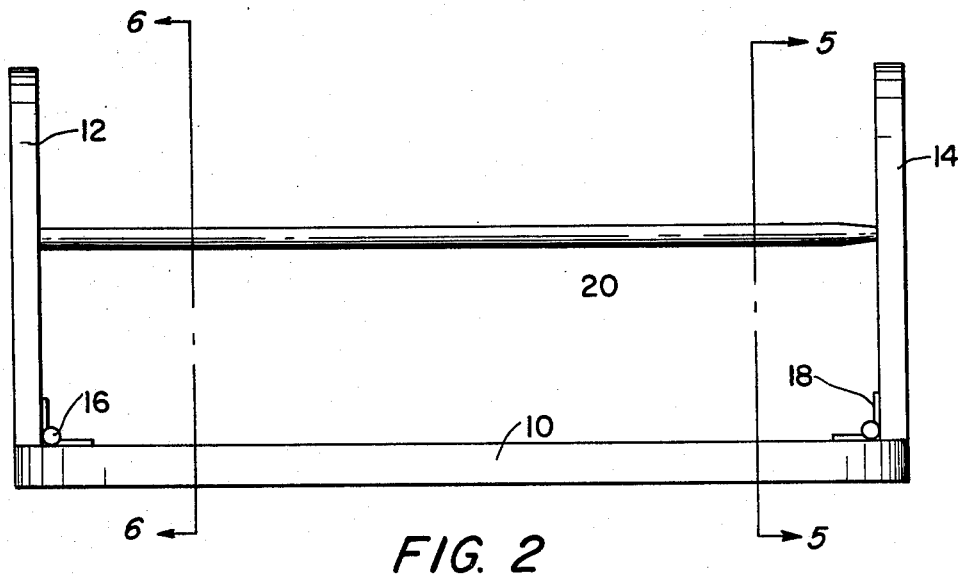
FIG. 2 is a side view.

As is seen in FIGS. 1 - 3 when my device is in its operative position an elongated rod member 20 extends between the end members 12 and 14. The left end of the elongated rod member 20 (as seen in FIGS. 1 - 3) can be perfectly cylindrical so that it is well adapted to fit within a shallow cylindrical cavity or rod seating means 22 located in end member 12 (see FIG. 6). This end of the elongated rod member is preferably seated first. The right end of the elongated rod member 20 (as seen in FIGS. 1 - 3) is preferably rounded or tapered somewhat so that it will more easily penetrate through a skein and also so that it will more easily slide downwardly through the groove 24 before seating in a cavity or seating means 26 that is disposed across from seating means 22. The size and shape of the ends of rod member 20 can be designed with respect to the size and shape of seating means 22 and 26 so that the rod member can be either non-rotatable or freely rotatable.

I have found that a groove 24 in the face of at least one of the end members is very useful in facilitating the placement of the rod member 20 in its desired operative position between the end members 12 or 14. The depth of the goove 24 is preferably at least a little less than the depth of the cavity 26 so that once the tapered end of the rod member 20 is seated in seating means 26 it will not be unseated by pulling on the skein.

I claim:

1. A device for holding and dispensing a skein of textile material such as yarn or the like, comprising in combination a. a base member having a generally planar and rectangular configuration, b. two spaced apart planar and generally rectangular end members positioned adjacent opposite ends of said base member and which in their operative positions are parallel to each other and perpendicular to said base member, c. two spaced apart hinge members, one hinge member connecting one end member to the upper surface of said base member and the other hinge member connecting the other end member to the upper surface of said base member, said hinge members interconnecting said end members to said base member in such a way that the end members can pivot toward and away from each other through an angle of approximately 90°, d. rod seating means located in both of said end members in the sides of the end members that face each other when the end members are in their operative position, e. an elongated rod member extending between said end members when the end members are in their upright operative position, the ends of said rod member being seated in said rod seating means so that the rod member is disposed essentially parallel to said base member and spaced thereabove, said rod member being adapted to hold a skein of textile material, and f. an elongated vertical groove in the facing surface of one of said end members, said elongated vertical groove extending between the upper periphery of said end member and the rod seating means located immediately beneath it on said facing surface, said elongated vertical groove facilitating the seating and unseating of one end of said rod member in said rod seating means.

* * * * *